US007021137B1

(12) United States Patent
Milone

(10) Patent No.: US 7,021,137 B1
(45) Date of Patent: Apr. 4, 2006

(54) APPARATUS FOR RAPIDLY MEASURING LIQUID LEVELS AND VOLUME OF GROUNDWATER WITHIN WELLS THAT ELIMINATES CROSS CONTAMINATION BETWEEN WELLS

(76) Inventor: Christopher J. Milone, 51 Andover St., Andover, MA (US) 01810

( * ) Notice: Subject to any disclaimer, the term of this patent is extended or adjusted under 35 U.S.C. 154(b) by 0 days.

(21) Appl. No.: 11/007,408

(22) Filed: Dec. 8, 2004

Related U.S. Application Data

(62) Division of application No. 09/944,767, filed on Aug. 31, 2001, now Pat. No. 6,829,928.

(51) Int. Cl.
*G01F 23/24* (2006.01)

(52) U.S. Cl. ..... 73/304 R

(58) Field of Classification Search ..... None
See application file for complete search history.

(56) References Cited

U.S. PATENT DOCUMENTS 3,911,744 A * 10/1975 Edwards ..... 73/304 R
4,382,382 A * 5/1983 Wang ..... 73/304 R
4,967,594 A * 11/1990 Ehrenfried et al. ..... 73/301
5,565,687 A * 10/1996 Berrill ..... 73/314

* cited by examiner

*Primary Examiner*—Hezron Williams
*Assistant Examiner*—Paul M. West
(74) *Attorney, Agent, or Firm*—Robert Nathans

(57) ABSTRACT

A dedicated liquid level detection method having a sensor positioned into the casing of a groundwater well. The detector is in the form of an elongated thin film sensor tape that extends along the full length of the well casing which detects the level, thickness and volume of both groundwater and any light or dense non-aqueous phase liquid that may be present.

This is accomplished through the use of a conductive and hydrostatic resistive circuit measuring the level of liquids in a groundwater well at one hundredths of foot resolution or greater. Once the elongated sensor is installed, liquid levels can be gauged from the surface. The data is stored using a battery operated hand held digital display temporarily connected at the top well section casing. Since a sensor probe is not lowered into the well, cross contamination between wells is eliminated.

14 Claims, 5 Drawing Sheets

APPARATUS FOR RAPIDLY MEASURING LIQUID LEVELS AND VOLUME OF GROUNDWATER WITHIN WELLS THAT ELIMINATES CROSS CONTAMINATION BETWEEN WELLS

RELATED APPLICATIONS

This application is a divisional application of U.S. application Ser. No. 09/944,767 filed Aug. 31, 2001 now U.S. Pat. No. 6,829,928 issued to Christopher Milone.

FIELD OF THE INVENTION

The invention relates to the field of measurement of liquid levels in groundwater wells, storage tanks, vessels and other liquid containers.

BACKGROUND OF THE INVENTION

This invention relates to devices known as liquid level detectors, interface probes, and pressure transducers which are used to gauge the depth of groundwater and/or any light non-aqueous phase liquids (LNAPL) or dense non-aqueous phase liquids (DNAPL) i.e. petroleum or solvents respectively, Traditionally, in accordance with the prior art, monitoring wells are gauged using invasive detection devices with a sensor probe attached to a graduated tape that is wound on a reel. The sensor probe is lowered into the monitoring well casing until the sensor probe comes in contact with the subsurface media i.e. groundwater, in the well. To detect liquids, these devices use an infra-red emitter and detector. When the probe enters a liquid the infra-red beam is refracted away from the detector, which activates an audible alarm and light. If the liquid is non-conductive (NAPL) the alarm and light are steady. If the liquid is water, a conductive liquid, the water completes a conductivity circuit. This overrides the infrared circuit, and the tone and light are intermittent. The total depth of the well is determined by lowering the sensor probe to the bottom of the well. The measurement is read from the graduated tape and the depth of each media is manually recorded. Errors can be introduced through transcription and by misreading the graduated tape.

If a non-aqueous NAPL such as petroleum is present, the sensor probe and measurement tape can become smeared with petroleum, which in some cases can be difficult to completely remove from the sensor probe and tape. The decontamination process must be thorough to avoid leaving behind any petroleum residues. In accordance with state and federal environmental regulations, these devices must be thoroughly decontaminated between use in each monitoring well to prevent cross-contamination from well to well in subsurface groundwater. This is an important step in the prior process which is time consuming and consequently costly. In addition, when the probe is removed the field personnel gauging the well, run the risk of being exposed to contaminants in the well.

The present invention avoids prior art tape-reading errors and transcription errors by displaying the gauged values on a hand-held digital display unit where they can be stored electronically and later transferred directly to a computer. There is no decontamination procedure necessary, since the sensor tape is part of the well and there is no contact with contaminated groundwater which can be transferred from one well to the next or from the well to field personnel.

Regarding groundwater sampling and well volumes, in order to determine groundwater quality it is necessary to collect samples of groundwater and submit them for laboratory analysis. Prior to collecting a groundwater sample a specified volume of groundwater (typically 3 well volumes) must be withdrawn from the well in order to obtain a sample representative of the aquifer. The volume of groundwater within the monitoring well casing is calculated using the measured depth to water and total depth of the well. In addition it is necessary to determine the volumes of any NAPL that may be present in a well to determine the extent of release of such liquids. The invention disclosed herein, calculates and displays the thickness and volume of water and any LNAPL or DNAPL on the hand held digital display unit.

Aquifer tests such as pumping tests and slug tests are used to determine site-specific aquifer parameters such as hydraulic conductivity, transmissivity and storage coefficients. These tests are performed while groundwater levels in monitoring wells are continuously monitored and recorded. This is typically accomplished through the use of a pressure transducer probe installed in a monitoring well, penetrating the groundwater and attached via chords to a data logger at the surface. These data loggers collect and store the groundwater level data for subsequent determination of aquifer parameters. The pressure transducers must also be decontaminated between each use to prevent cross-contamination.

The invention disclosed herein can also monitor and store groundwater level data during these aquifer tests for subsequent determination of aquifer parameters.

Regarding well locating, it is sometimes difficult to determine if the well being gauged or sampled is the well of interest. This is particularly a problem at sites with numerous wells located relatively close together and installed at similar depths. Groundwater data collected is invaluable in determining site conditions accurately and gauging and sampling the correct well is paramount.

In the aforesaid prior art apparatus, an elongated resistive sensor tape was employed to detect the level of a liquid using the hydrostatic pressure of the liquid in which it is immersed. The hydrostatic sensor consists of a conductive base strip that is partially insulated from a resistive wire that is wound around the base strip to form a helix. The sensor tape is encapsulated in an outer protective envelope to insulate the sensor from the liquid in which it is immersed. When the sensor is immersed in a liquid the hydrostatic pressure of the liquid compresses the envelope. This causes the wire to contact the base strip, which results in a change in resistance of the wire. The resistance of the wound wire corresponds to the distance from the top of the sensor tape to the liquid surface. See U.S. Pat. No. 4,816,799 to Ehrenfried et al., assigned to Metritape Inc. of Littleton. Mass.

A disadvantage of this prior art sensor is that it only can detect the level of a single liquid, e.g. water or petroleum. The sensor can not distinguish between the two in the same well, tank or vessel. In addition, the resolution of the sensor is limited by the minimum spacing between windings of the resistive wire (two hundredths of a foot).

The invention disclosed herein, utilizes an elongated resistive sensor tape that incorporates both a hydrostatic and conductive resistive circuit capable of distinguishing between a conductive liquid (water) and a non-conductive liquid (petroleum) at a resolution of one hundredth of a foot and greater. The resolution is limited only by the smallest spacing possible between contacts of individual thin film transistor circuits in the neighborhood of micrometers.

SUMMARY OF A PREFERRED EMBODIMENT OF THE INVENTION

An elongate thin film sensor tape circuit 1, in FIG. 1, is incorporated into the inside annulus of a groundwater well casing 3 so that is in contact with any liquid present in the well. The sensor tape's outer jacket has a smooth non-stick surface to prevent build up of highly viscous liquids and includes a conductive resistive circuit that detects the level of water that conducts current in contrast with contaminants. An array of tiny stainless steel electrodes 5 exposed at the surface of the sensor tape at 0.01-foot intervals along the length of the sensor tape, sense the presence of water such that an electrical resistance measured at the top of the well casing is proportional to the depth of the water in the well. The thin film sensor tape circuit also includes a hydrostatic sensing circuit 7 that is sensitive to the actuation pressure of any liquid, (water or NAPL), in which it is immersed. This circuit consists of a network of resistors 9 with an intervening pair of contacts 11 at 0.01-foot intervals. As the level of the liquid rises, the increased hydrostatic pressure of the liquid compresses a movable overlying metal base strip incorporated in the outer jacket of the sensor tape against the contacts such that the electrical resistance measured at the top of the well casing is proportional to the depth of the liquid in the well. Regarding this device, note the hydrostatic sensor of the aforesaid Ehrenfried patent discussed above. In addition the sensor tape includes a series network of resistors 13 proportional to the total length of the sensor tape sections.

The sensor tape 1 extends along the full length of each well section. The well casing consists of one, two, five or ten-foot modular sections of slotted well screen or blank casing, which have the sensor tape incorporated therein. The modular sections 3 can be connected using various lengths to obtain the desired well depth. Specialized bottom and top cap sections, 15 and 17 respectively, are connected to complete the sensor circuit. The top cap, in addition to completing the circuit, houses the display connector and a non-volatile memory circuit that stores pertinent well information such as: the identification number; installer; installation date; depth; diameter; and top of casing elevation. Electrical interconnects are made in the coupling of the modular well casing sections using a specialized connector and double o-ring arrangement to prevent exposure of the connections to the liquid in which it is immersed. A hand held digital processor unit measures the electrical resistances at the surface of the well casing, calculates and displays the level, thickness and volume of water and any light LNAPL or dense DNAPL.

DETAILED DESCRIPTION OF PREFERRED EMBODIMENTS OF THE INVENTION

Figure 1:
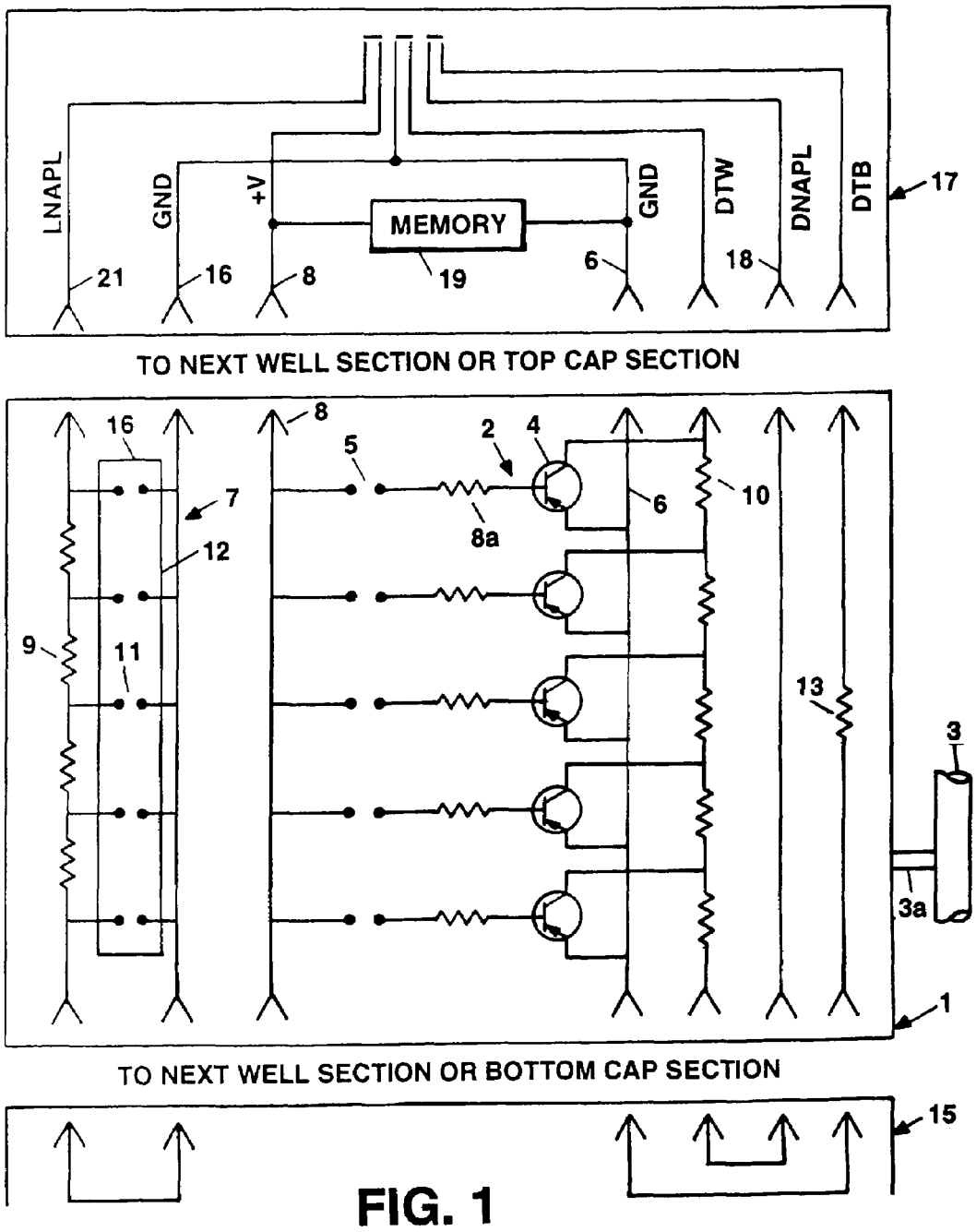
FIGS. 1 and 5 disclose a preferred embodiment of the invention.
Figure 2:
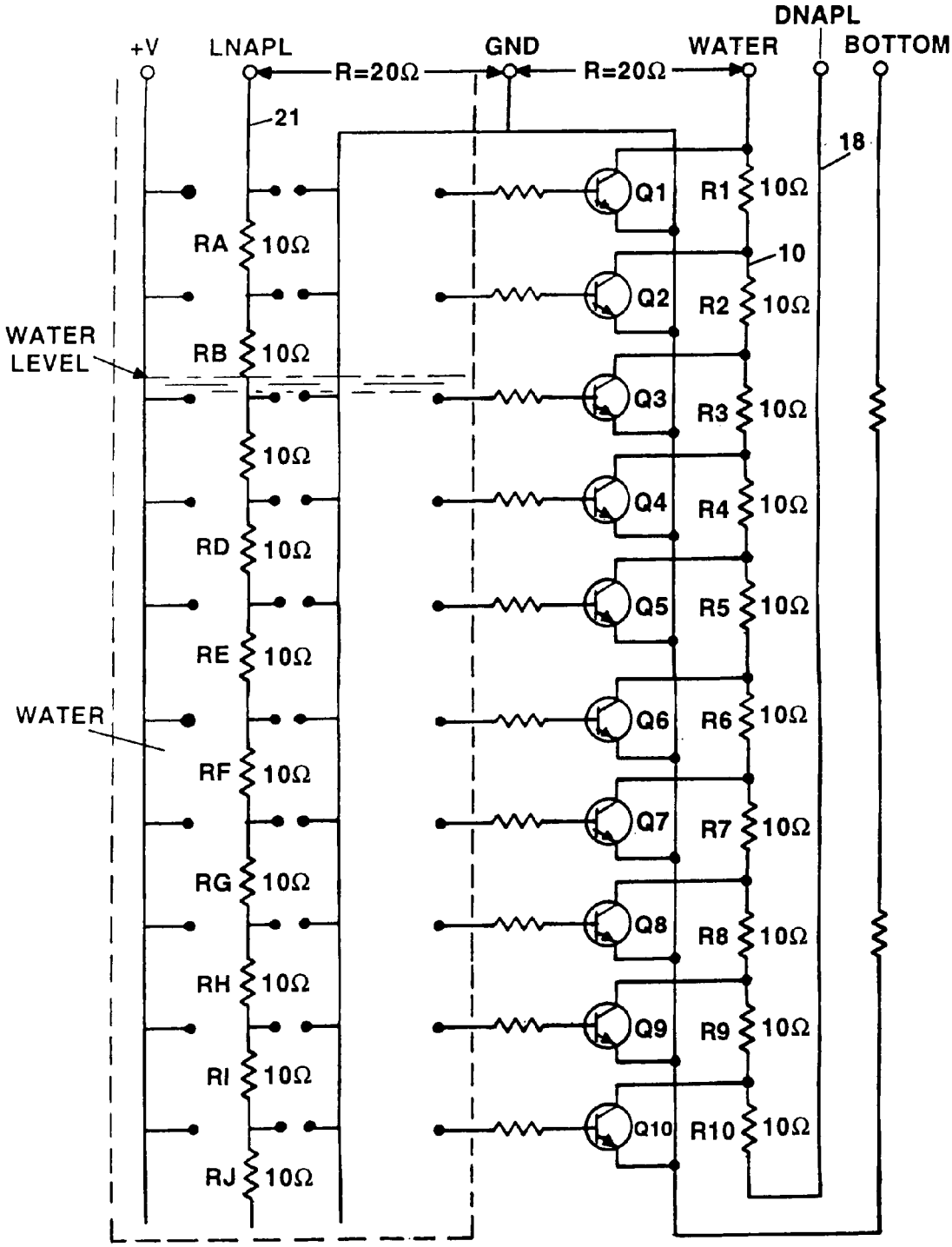
FIG. 2 illustrates measurement of a column of water.

Referring now to FIGS. 1 and 2, an elongate thin film sensor tape circuit 1 includes a conductive resistive circuit that distinguishes between water a conductive liquid and NAPL a non-conductive liquid. The water detecting conductive circuit 2 is comprised of a series of transistor switches 4 with the collector lead of each transistor tapping a series network 10 of, for example, 10-ohm resistors so that one resistor separates each successive collector lead as shown in FIG. 1*a*. The emitter lead of each transistor is tied to ground lead 6. When there is no water bridging the contacts 5 between the source voltage lead 8 and its associated base resistor 8*a*, the transistor is cut off and acts like and open switch from the collector to the emitter. When water bridges the contacts between the source voltage and the base resistor a sufficient base current is allowed to flow and drive the transistor into saturation and the transistor acts like a closed switch from the collector to the emitter. When no water is present, all the transistor switches are open and the resistance as measured from the top of the series resistor network 10 to ground is infinite (i.e. an open circuit) as there is no return path to ground. When water enters the well and trips the lowest transistor switch Q10, the resistance as measured from the top of the series resistor network 10 to ground is the total sum of all the resistors in series. As the level of water rises, successive contacts 5 are bridged, closing successive transistor switches; successive resistors are effectively removed from the series resistor network. This decreases the resistance as measured from the top of the well casing. Thus, the measured resistance, or conductive liquid output signal fed to data processor 25 shown in FIG. 5, is proportional to the depth of water in the well.

Thus, a series of non-movable water sensing electrode means is provided, as clearly shown in FIG. 1, wherein each water sensing electrode means includes a pair of electrical contacts or electrodes 5, exposed to water in the well along with a voltage controlled switch 2, in turn electrical coupled to an associated resistor of the series resistive string 10.

The thin film sensor tape circuit 1 also includes a hydrostatic sensing circuit 7 that is sensitive to the actuation pressure of any liquid (conductive or non-conductive) in which it is immersed. This circuit consists of a series network of resistors 9 with pairs of intervening contacts at 0.01-foot spacing. One contact is connected between each successive resistor in the series network; the other is connected to ground lead 16. As the level of the liquid rises the hydrostatic pressure of the liquid compresses a slightly movable overlying metal base strip 12 against the circuit contacts and successive contacts are bridged. This effectively removes successive resistors from the series resistor network and decreases the resistance as measured from the top of the well casing. Thus, the measured resistance is proportional to the depth of any type of liquid in the well and thus constitutes an all liquid output signal fed to the data processor 25 shown in FIG. 5. In addition, the sensor tape includes a series resistor network 13 proportional to the total length of the sensor tape 1. Each sensor tape section contains a resistor proportional the length of that section. When well sections are connected in tandem, to extend the sensor tape to the bottom of the well, the resistance as measured from the top of the well casing is proportional to the total depth of the well.

Figure 5:
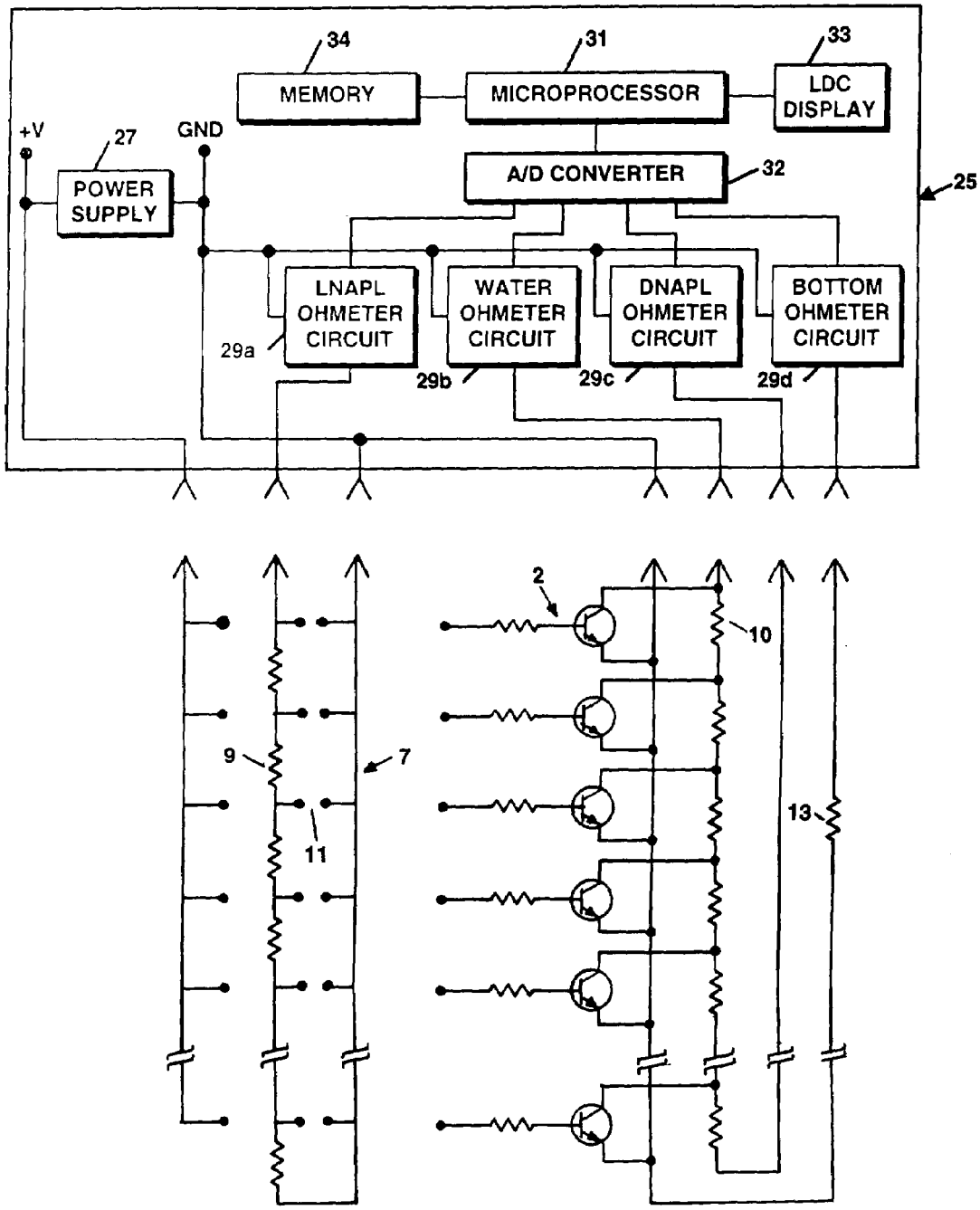

The presence, depth, thickness and volume of water and any DNAPL or LNAPL are preferably carried out in the data processor 25 of FIG. 5. These parameters are determined as follows: the depth of water in the well is determined by measuring the effective resistance of the conductive circuit 2 as discussed above. The layer thickness or height of the water column in the well can then be determined by subtracting the measured resistance of the conductive circuit from the measured resistance 13 of the total depth of the well. The volume of water in the well is calculated using the measured layer thickness of the water and the inside diameter of the well casing.

Regarding LNAPL, the depth of any floating LNAPL is determined by measuring the resistance of the hydrostatic circuit 7 from the top of the well casing. Note that the LNAPL resistance measuring terminal 21 is connected to the top of the hydrostatic resistance network 7. If the measured resistance of the hydrostatic circuit 7 is equal to the measured resistance of the water detecting conductive circuit 2 when the two signals are compared, then no LNAPL is present. If the measured resistance of the hydrostatic circuit is less than the measured resistance of the conductive circuit when the two signals are compared, then a LNAPL is present and this measured resistance represent the depth of the LNAPL. The thickness of the LNAPL can then be determined by subtracting the measured resistance of the hydrostatic circuit from the measured resistance of the conductive circuit. The volume of LNAPL in the well is calculated using the measured thickness or height of the LNAPL and the inside diameter of the well casing.

Regarding DNAPL, the depth of any sinking DNAPL in the well is determined by measuring the resistance of the conductive circuit from the bottom of the well casing. Note that the DNAPL terminal 18 is connected to the bottom of the resistance network 10 of the conductive circuit 2. If this measured resistance is equal to zero-Ohms, then there is no DNAPL present as the presence of water at the bottom produces a ground condition there. If the measured resistance is greater than zero-Ohms then there is DNAPL present and this measured resistance corresponds to the thickness of the DNAPL layer. The depth of DNAPL is determined by subtracting the thickness of the DNAPL from the measured resistance of the total depth of the well. The volume of DNAPL in the well is calculated using the measured layer thickness of the DNAPL and the inside diameter of the well casing.

The battery operated, hand held digital processor/display unit 25 of FIG. 5, is connected to the top of the well casing as shown, to measure the aforesaid resistance values. The display unit 25 consists of a power supply circuit 27, resistance measuring circuits 29*a*–29*d*, (ohmmeters), an analog to digital converter 32 and microprocessor 31 to translate the measured values for processing and performing the calculations and displaying the level, thickness and volume of water and any LNAPL or DNAPL present on liquid crystal display 33. Memory 34 includes software to translate the data. The unit 25 is temporarily connected to the top section of each well being evaluated and can store data from many wells. The unit can then be taken back to the office and the data can be transferred to a PC. Specific well information such as well identification number, and depth, diameter and top of casing elevation resides in a memory chip in the top section of the well.

Thus, data processor 25 positioned at the top of the well processes the conductive liquid output signal and the all liquids output signal for determining thickness of layers of groundwater and any light or dense non-aqueous non-electrically conductive phase liquid in said well.

To provide further clarification, the following examples are provided which employ a single hypothetical 0.10 foot tape section positioned in a hypothetical "well" having a depth of 0.10 foot. Of course, for a real well, much longer and numerous tape sections are coupled together in tandem as mentioned previously. More specifically, the depth of water in the well is determined by measuring the effective resistance of the conductive circuit 10 as shown in FIG. 1. In the example shown in FIG. 1*a*, the water level in the well is at the level of the contacts at transistor Q3. The water bridges the contacts and current is allowed to flow to transistor Q3 and the transistor behaves like a closed grounding switch from the collector to the emitter. Therefore, the resistance measured from the top of the well to the resulting ground is 20-ohms, which is the sum of the two 10-ohm resistors (R1+R2). This corresponds to a depth to water of 0.02 feet (10-ohms per 0.01-feet). The thickness or height of the water column in the well can then be determined by subtracting the measured resistance of the conductive circuit (depth to water) from the measured resistance of the total depth of 0.10 foot, of the hypothetical well. Since the contacts are spaced at 0.01-foot intervals, in this example the well is only 0.10 feet deep. The thickness of the water column is equal to:

$$0.10 \text{ feet} - 0.02 \text{ feet} = 0.08 \text{ feet}$$

The volume of water in the well is calculated using the measured thickness of the water and the inside diameter of the well casing (i.e. pi×radius squared×height, the volume of a cylinder.

Figure 3:
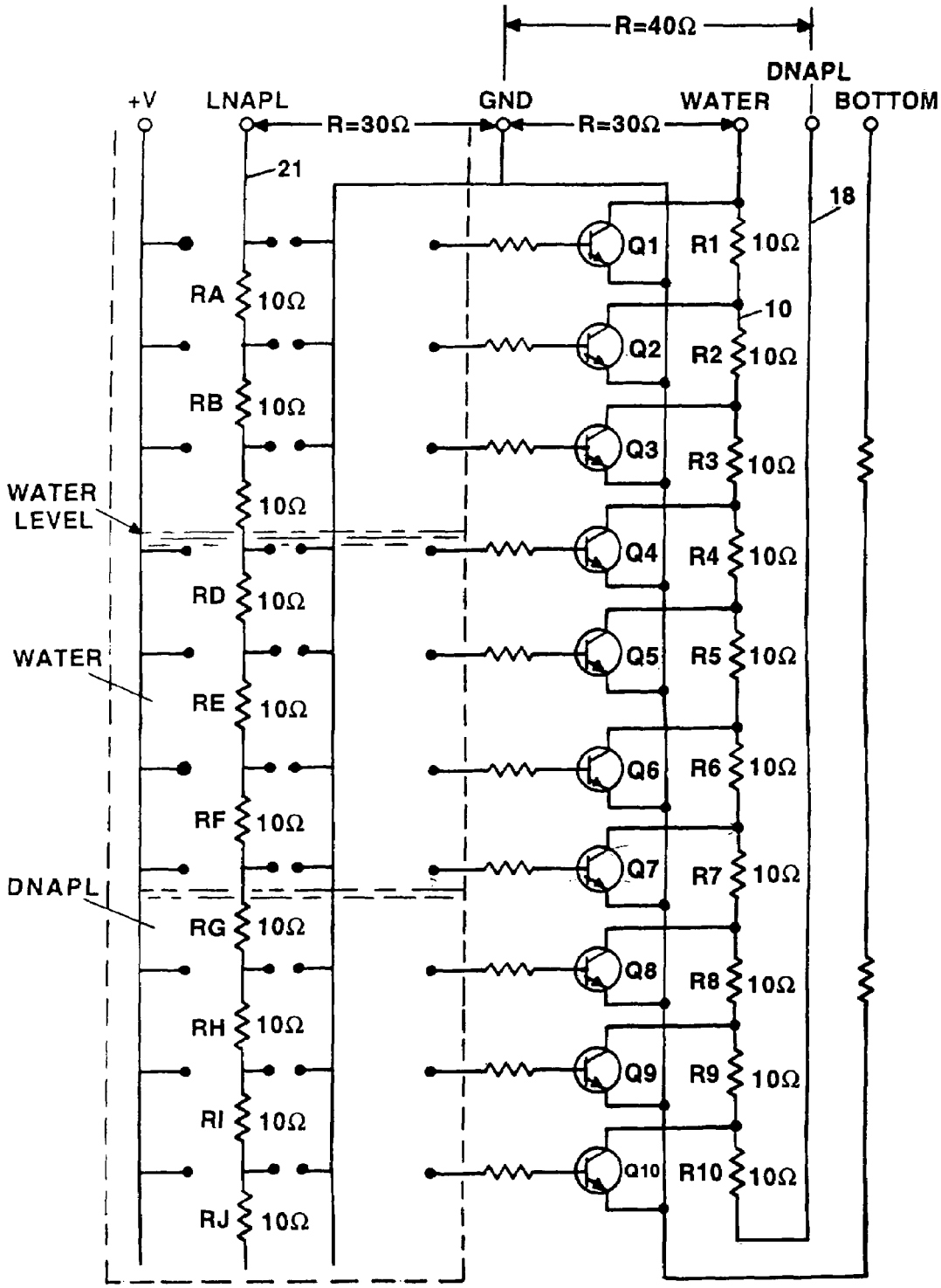
FIG. 3 illustrates measurement of a layer of DNAPL.

The depth of any DNAPL in the well is determined by measuring the resistance of the conductive circuit from the bottom of the bottom of the well casing as shown in FIG. 3. Note that dense liquids settle to the bottom. Note that DNAPL terminal 18 is connected to the bottom of resistance network 10 of conductive circuit 2. In the example shown in FIG. 2, the water/DNAPL interface in the well is at the level of the contacts at transistor Q7. The water bridges the contacts and current is allowed to flow to transistor Q7 and the transistor behaves like a closed switch from the collector to the emitter. Transistors Q8, Q9, and Q10 behave like open switches since DNAPLs are non conductive liquids and current is not allow to flow to the base of these transistors. Therefore, the resistance measured from the bottom of the well to ground, established by the presence of water at transistor Q7, is 40-ohms which is the sum of the four 10-ohm resistors (R7+R8+R9+R10). This measured resistance from DNAPL terminal 18 to ground corresponds to the thickness of the DNAPL 0.04 feet (10-ohms per 0.01-feet). The depth of DNAPL is determined by subtracting the DNAPL thickness from the measured resistance of the total depth of the well as follows:

$$0.10 \text{ feet} - 0.04 \text{ feet} = 0.06 \text{ feet}$$

The volume of DNAPL in the well is calculated using the measured thickness of the DNAPL and the inside diameter of the well casing.

Figure 4:
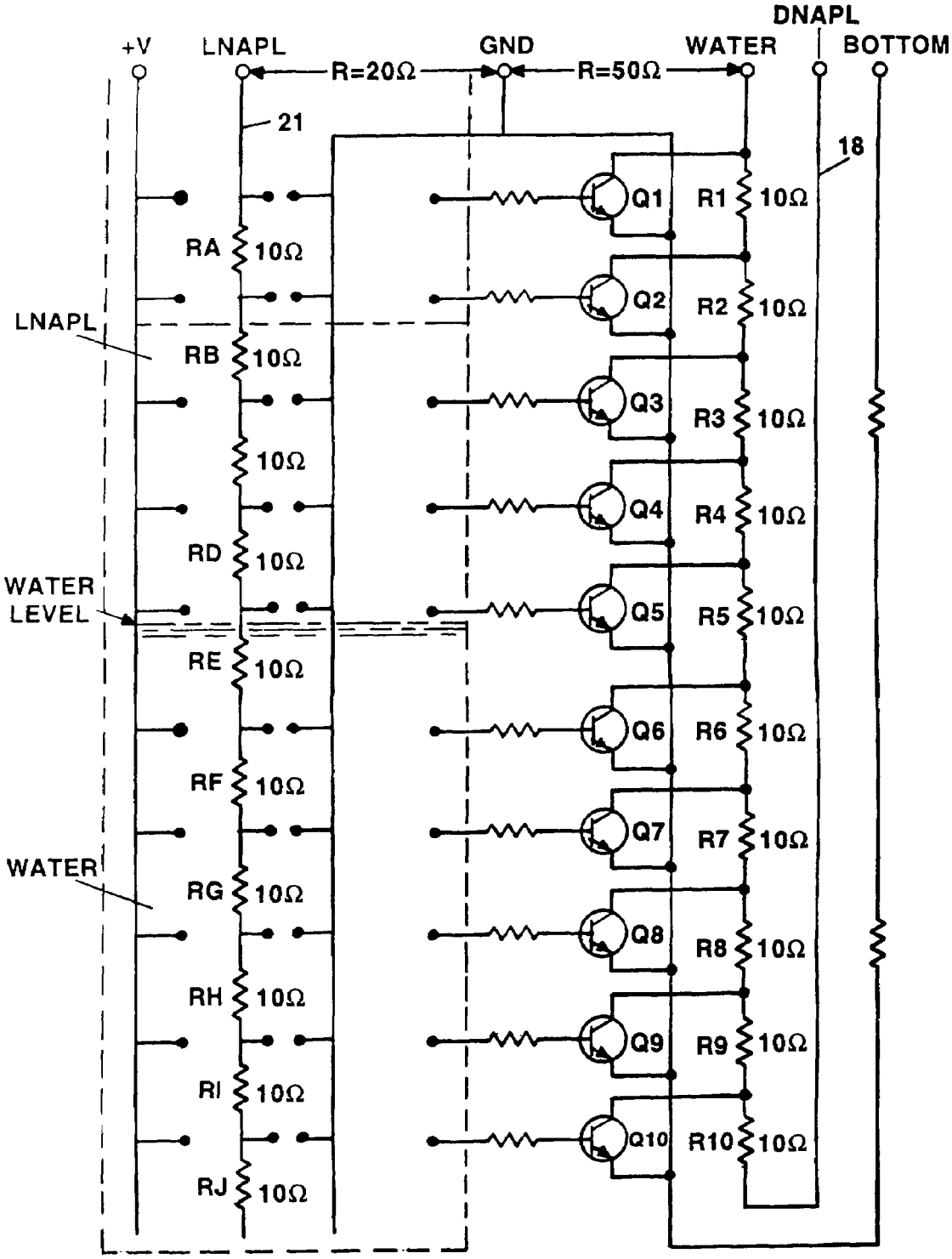
FIG. 4 illustrates measurement of a layer of LNAPL

The depth to any LNAPL is determined by measuring the resistance of the hydrostatic from the top of the well casing as shown in FIG. 4. Note that light liquids rise to the top of the water column. If the measured resistance of the hydrostatic circuit 7 is equal to the measured resistance of the conductive circuit 2, then no LNAPL is present, as shown in FIG. 2. As shown in FIG. 3, if the measured resistance of the hydrostatic circuit (20-ohms) is less than the measured resistance of the conductive circuit (then a LNAPL is present in the well. The measured resistance represents the depth of the LNAPL and is equal to 0.02 feet (10-ohms per 0.01-feet). The thickness of the LNAPL can then be determined by subtracting the measured resistance of the hydrostatic circuit from the measured resistance of the conductive circuit as follows:

$$0.05 \text{ feet} - 0.02 \text{ feet} = 0.03 \text{ feet}$$

The volume of LNAPL in the well is calculated using the measured thickness of the LNAPL and the inside diameter of the well casing.

Thus, data processor 25 positioned at the top of the well is employed to processes the conductive liquid output signals and the all liquids output signals for determining layer thickness, and by multiplication with well diameter measurements, volumes of layers of groundwater and any light or dense non-aqueous non-electrically conductive phase liquid in the well.

Since variations on the aforesaid description will occur to one skilled in the art, the invention is to be restricted solely to the following terms in the claims and also art recognized equivalents thereof. For example, the resistive networks could comprise equivalent non-resistive impedance devices if AC was substituted for the DC source. The term "well" as used herein is intended to cover any container, storage tank, receptacle or reservoir for a liquid and not just a conventional ground water well.

I claim:

1. Apparatus for measuring aqueous liquid layers in a well comprising:

(a) an elongated water level measuring means positioned along the length of said well having a first string of series connected resistors together with a series of water sensing means, each water sensing means being electrically coupled to an associated resistor of said string of series connected resistors for electrically removing a resistor from said string of resistors upon the presence of water at each water sensing means;

(b) water level measuring means enabling measurement of the resistance of said string of resistors when said elongated water level measuring means is positioned within said well;

and wherein each water sensing means comprises a pair of electrical contacts for directly contacting said aqueous liquid along with a voltage controlled switch coupled between said pair of electrical contacts and a resistor of said series of resistors;

and wherein said elongated water level measuring means is mechanically coupled to support means extending along the length of said well for retaining said water level elongated measuring means in place within said well between well inspections, thereby eliminating lowering and raising said elongated water level measuring means into and out of said well that may require subsequent decontamination procedures;

and wherein the elongated water level measuring means includes a second string of series connected resistors having a total resistance proportional to the total length of the elongated water level measuring means extending to the bottom of said well and further including;

means for subtracting the measured resistance of said first series resistance circuit from the measured resistance of said second series circuit for indicating the thickness of a water layer in said well.

2. The apparatus of claim 1 wherein said elongated aqueous water measuring means is configured in the form of a thin film and said electrical contacts are closely spaced exposed to water at the surface of said thin film, thereby enabling very precise liquid level measurements.

3. An elongated sensor for measuring aqueous liquid layers in a well comprising:

(a) an elongated water level measuring means to be positioned along the length of said well having (a-1) a string of series connected resistors;

(a-2) a string of switches each switch coupled to an associated resistor of said series connected resistors for selectively electrically adding or removing resistors from said string of series connected resistors depending upon control voltages applied to switching control terminals of said switches;

(a-3) a string of electrical contact means for directly contacting said aqueous liquid for sensing the presence of water positioned along the length of said elongated water level measuring means, each electrical contact means coupled to a control terminal of said switch of said string of switches;

(b) a voltage input terminal coupled to said string of electrical contact means for producing first control signals applied to switching control terminals of said string of switches when water bridges the electrical contact means and for producing second control signals in the absence of water bridging said electrical contact means in order to electrically add or remove resistors from said string of series connected resistors; and (c) wherein said elongated water level measuring means is configured in the form of a thin film tape.

4. The apparatus of claim 3 including means for supporting said elongated water level measuring means along the entire length of a well.

5. The apparatus of claim 4 including means for measuring the resistance of said string of resistors indicative of the depth of the level of water in the well.

6. The apparatus of claim 3 including means for measuring the resistance of said string of resistors indicative of the depth of the level of water in the well.

7. Apparatus of claim 3 wherein the elongated water level measuring means includes a well depth series resistor network proportional to the total length of the elongated water level measuring means extending to the bottom of said well.

8. Apparatus of claim 7 wherein said elongated water level measuring means comprises a thin film tape mechanically coupled to tape support means extending along the length of the well for retaining said thin film tape in place within said well between well inspections thereby eliminating lowering and raising said tape into and out of said well that may require subsequent decontamination procedures.

9. Apparatus of claim 3 wherein said elongated water level measuring means is mechanically coupled to support means extending along the length of the well for retaining said elongated measuring means in place within said well between well inspections, thereby eliminating lowering and raising said elongated water level measuring means into and out of said well that may require subsequent decontamination procedures.

10. Apparatus of claim 9 wherein the elongated water level measuring means includes a well depth series resistor network proportional to the total length of the elongated water level measuring means extending to the bottom of said well.

11. Apparatus for measuring aqueous liquid layers in a well comprising:

(a) an elongated water level measuring means positioned along the length of said well having a string of series connected resistors together with a series of non-movable water electrode means for directly contacting said aqueous liquid, each water sensing electrode means being electrically coupled to an associated resistor of said string of series connected resistors for electrically removing a resistor from said string of resistors upon the presence of water at each non-movable water sensing electrode means; and (b) water level measuring means enabling measurement of the resistance of said string of series connected resistors when said elongated water level measuring means is positioned within said well; and (c) wherein each non-movable water sensing electrode means for directly contacting said aqueous liquid comprises a pair of electrical contacts exposed to water in said well along with a voltage controlled switch coupled between said pair of electrical contacts and an associated resistor of said string of series connected resistors.

12. Apparatus of claim 11 wherein said elongated water level measuring means is configured in the form of a thin film tape.

13. Apparatus of claim 11 wherein said elongated water level measuring means is mechanically coupled to support means extending along the length of said well for retaining said elongated measuring means in place within said well between well inspections thereby eliminating lowering and raising said tape into and out of said well that may require subsequent decontamination procedures.

14. Apparatus of claim 11 wherein the elongated water level measuring means includes a well depth series resistor network proportional to the total length of the elongated water level measuring means extending to the bottom of said well.

* * * * *